United States Patent [19]

Ritter

[11] 4,454,466

[45] Jun. 12, 1984

[54] POWER SUPPLY HAVING AUTOMATICALLY VARIED PRIMARY TURNS

[75] Inventor: Rolland R. Ritter, St. Paul, Minn.

[73] Assignee: Control Data Corporation, Minneapolis, Minn.

[21] Appl. No.: 444,946

[22] Filed: Nov. 29, 1982

[51] Int. Cl.[3] ..... G05F 1/44

[52] U.S. Cl. ..... 323/258; 323/266

[58] Field of Search ..... 323/255, 258, 266, 279, 323/340, 343

[56] References Cited

U.S. PATENT DOCUMENTS

| | | | |
|---|---|---|---|
| 3,305,764 | 2/1967 | Todd | 323/279 |
| 3,405,319 | 10/1968 | Barringer | 323/279 X |
| 3,651,375 | 3/1972 | Ebersohl | 317/11 E |
| 3,729,673 | 4/1973 | Schneider | 323/43.5 S |
| 3,913,007 | 10/1975 | Gilmore | 323/43.5 S |
| 3,947,755 | 3/1976 | Daute | 323/43.5 S |
| 4,061,958 | 12/1977 | Walker | 363/81 |
| 4,063,148 | 12/1977 | Fehlmann et al. | 323/43.5 S |
| 4,072,889 | 2/1978 | Witmer et al. | 323/258 X |

FOREIGN PATENT DOCUMENTS

| | | | |
|---|---|---|---|
| 55-61825 | 5/1980 | Japan | 323/279 |

*Primary Examiner*—William M. Shoop

*Attorney, Agent, or Firm*—E. J. Wasp; J. A. Genovese

[57] ABSTRACT

A transformer has a primary and a secondary. The primary is supplied by a source and is divided into permanent and selectable turns. Switch circuitry is connected by taps to the segments to selectively energize or de-energize them. The secondary is connected by a rectifier and filter to a voltage regulator which supplies a constant voltage to a load. Circuitry senses the voltage drop across the voltage regulator and comparator circuitry compares the series regulator voltage drop to reference values. The comparator generates error signals whenever the voltage drop falls outside of a desired range above the drop-out voltage of the regulator. The error signal is transmitted to an up/down counter which correspondingly increases or decreases its count. The count of the up/down counter is decoded by switch control circuitry to open and close the appropriate switches $S_1$–$S_6$ to energize the desired turns of the primary to bring the series regulator voltage drop back within the desired range.

4 Claims, 14 Drawing Figures

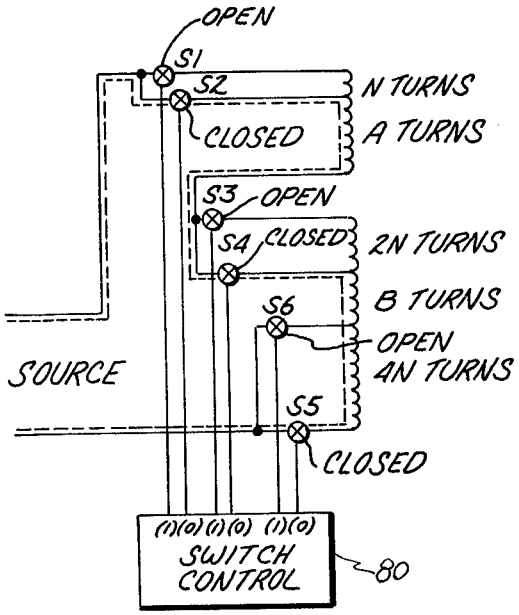
Fig.3e
Fig.3f
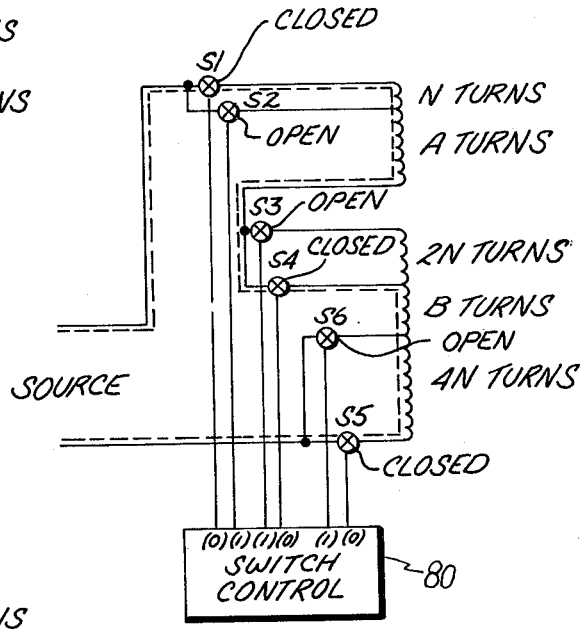
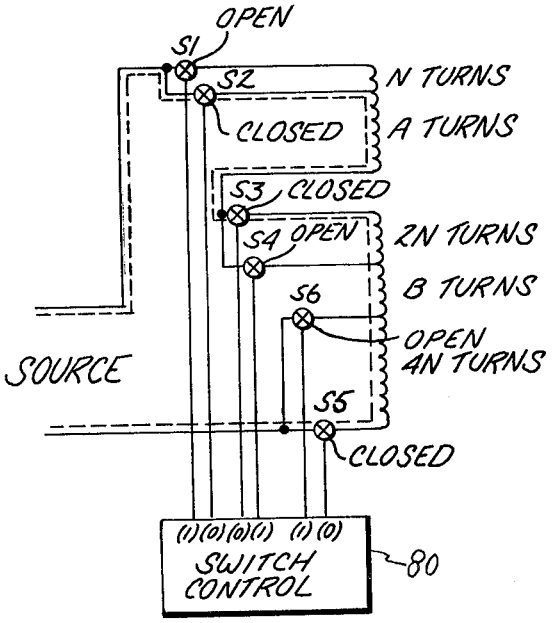
Fig.3g
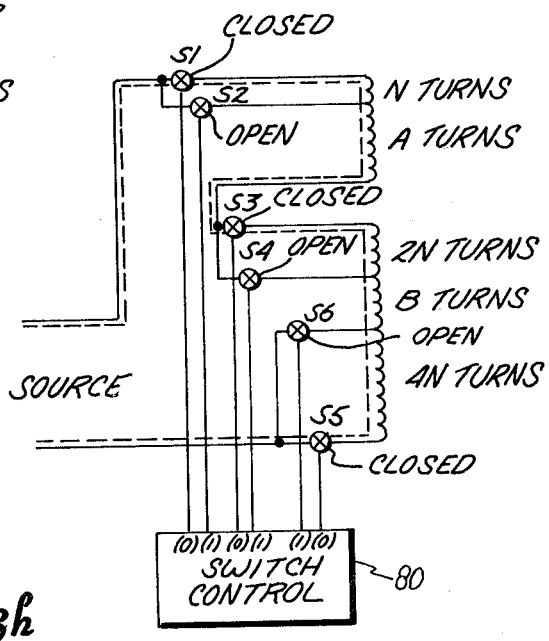
Fig.3h

POWER SUPPLY HAVING AUTOMATICALLY VARIED PRIMARY TURNS

BACKGROUND

The invention relates to devices to improve the efficiency of power supplies.

As the source voltage of the power supply and the load on it vary, it is difficult to maintain a specified output voltage without substantial energy dissipation in the regulator. This wastes power and requires substantial overdesign of the regulator to handle the worst case condition. Devices such as autotransformers can vary the voltage of the regulator using a mechanical actuator, but carry penalties associated with mechanical devices. Examples of such devices are shown in U.S. Pat. Nos. 4,063,148; 4,061,958; 3,947,755; 3,913,007; 3,729,673; and 3,651,375.

SUMMARY

The present invention, therefore, is to employ a transformer in which turns are electronically switched into or out of the primary of the transformer to compensate for line and load variations while minimizing the dissipation of energy in the regulator. Circuitry is employed to sense the regulator voltage drop and to vary the turns of the primary as necessary to maintain the series regulator voltge drop within a desired range.

It is, therefore, an object of the present invention to provide an improved power supply.

Yet another object is to minimize the amount of power dissipated in the power supply regulator.

Still another object is to provide a transformer in which turns of the primary can be selectively energized or de-energized to minimize power dissipation in the power supply regulator.

These and other objects, advantages and novel features of the present invention will become apparent from the following detailed description of the invention taken in conjunction with the accompanying drawings.

FIGS. *3a–3h* show how the switches $S_1$–$S_6$ are controlled to selectively energize the turns of the primary, with the dotted lines indicating the turns energized and the path of current.

Figure 4:
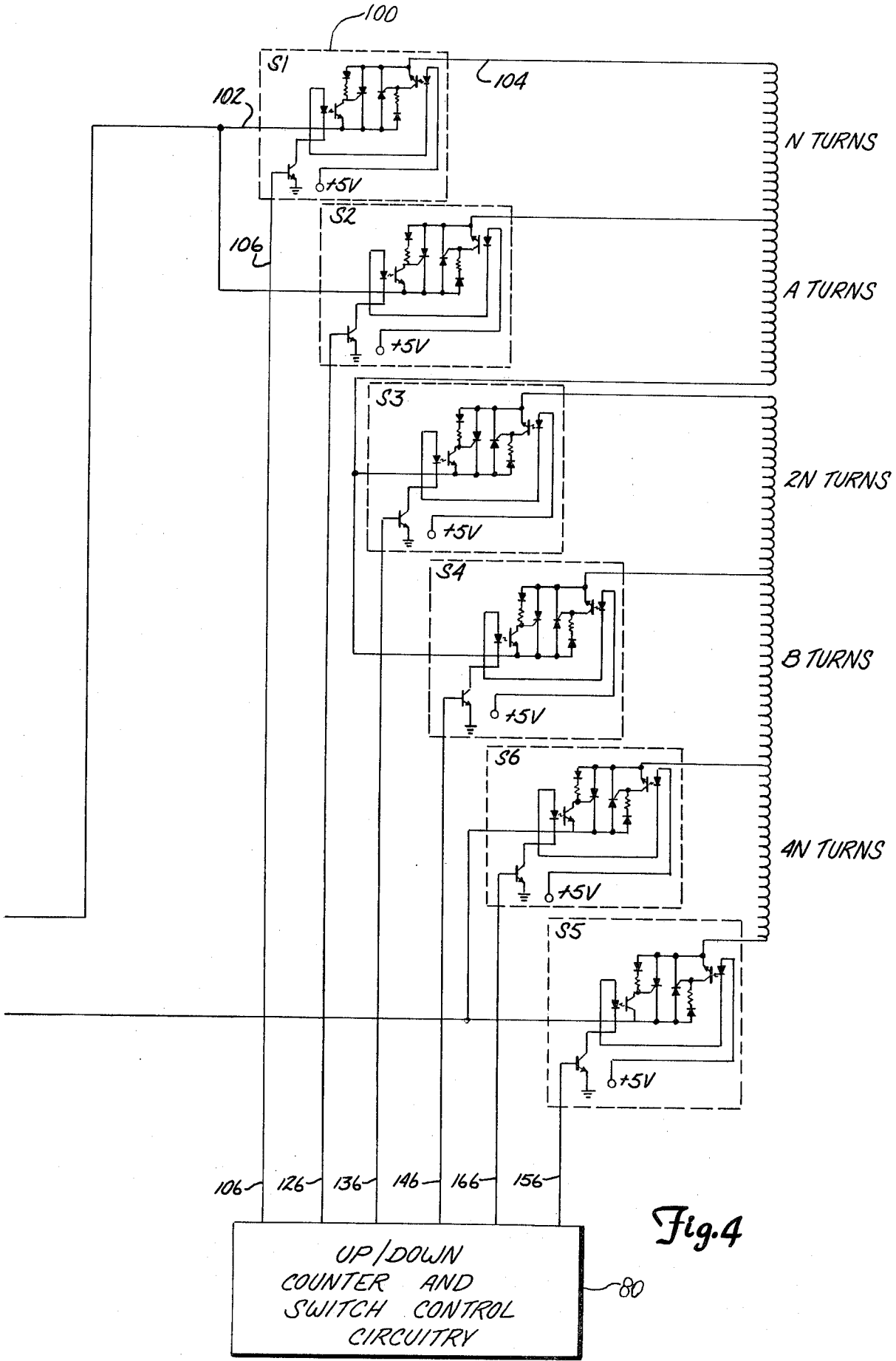

FIG. 4 shows the switch control circuitry of the present invention.

FIGS. *5a–5c* show the switch control circuitry and its two sets of conditions.

DESCRIPTION OF THE PREFERRED EMBODIMENT

The present invention comprises a transformer in which turns are electronically switched into or out of the primary of the transformer to compensate for variations in the line or load. The invention improves the efficieny of the power supply by minimizing the dissipation of power in the regulator necessary to ensure a stable voltage to the load.

Figure 1:
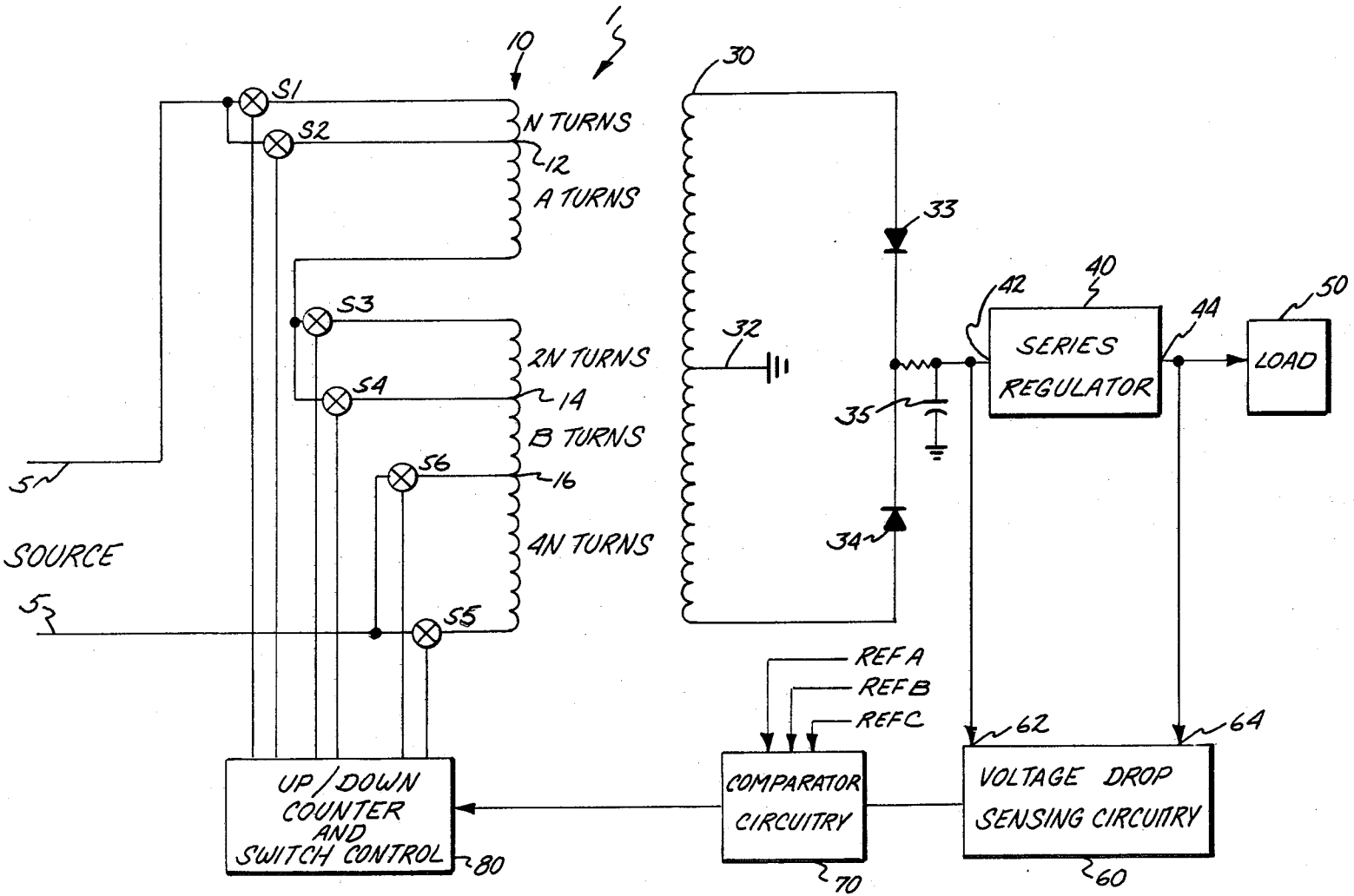
FIG. 1 is a partial schematic circuit diagram of the present invention.

With reference to FIG. 1, the transformer 1 has a primary 10 and a secondary 30. Primary 10 has a source voltage 5, and is divided into a number of segments A, B, N, 2N, and 4N by the taps 12, 14 and 16. As we will later describe more fully, the number of turns of the primary which are energized can be varied by selectively energizing segments of the primary. Note that wherever, in this specification, turns or segments, of the primary are said to be "energized", the term "energized" means that the turns, or segments, are carrying current directly from the source 5. Segments A and B comprise the minimum number of turns of the primary which are normally energized, and these are therefore called the the "permanently" energized turns. Segments N, 2N and 4N, on the other hand, are selectively energized by the switch control circuitry later described, and they are therefore known as "selectively" energized turns. Segment 2N has twice as many turns as segment N, and segment 4N has four times as many turns as segment N. Consequently, the minimum number of turns normally energized are the turns of the A+B segments, while the maximum number turns which can be energized are A+B+N+2N+4N or A+B+7N turns. The segments A, B, N, 2N, and 4N are controlled by switches $S_1$–$S_6$ in a manner later described.

In the present embodiment, secondary coil 30 has a center tap ground 32. Rectifying diodes 33, 34 and a filter 35 are connected intermediate to secondary 30 and a series regulator 40. Series regulator 40 has an input 42 and an output 44 and ensures that a constant voltage is supplied to load 50 by dropping the voltage above that required by load 50 between its input 42 and its output 44. For example, if load 50 requires 40 volts and input 42 to series regulator 40 is 50 volts, 10 volts are dropped in regulator 40. If input 42 is 60 volts, 20 volts would be dropped in regulator 40. An object of the invention is to minimize this series regulator voltage drop between input 42 and output 44 as near as is practical to the minimum operating voltage drop or the "drop-out voltage" of regulator 40. Accordingly, regulator voltage drop detection circuitry 60 is operatively connected to the series regulator at 62 and 64 to detect the regulator voltage drop. This voltage drop is then compared by comparator circuitry 70 to the Reference A, Reference B and Reference C voltage levels (indicated in FIGS. 1 and 2) to ascertain whether the number of turns of primary 10 which are energized should be varied to produce the desired voltage drop at regulator 40. The relationship between the number of turns of primary 10 which are energized and the regulator voltage drop is later described.

Figure 2:
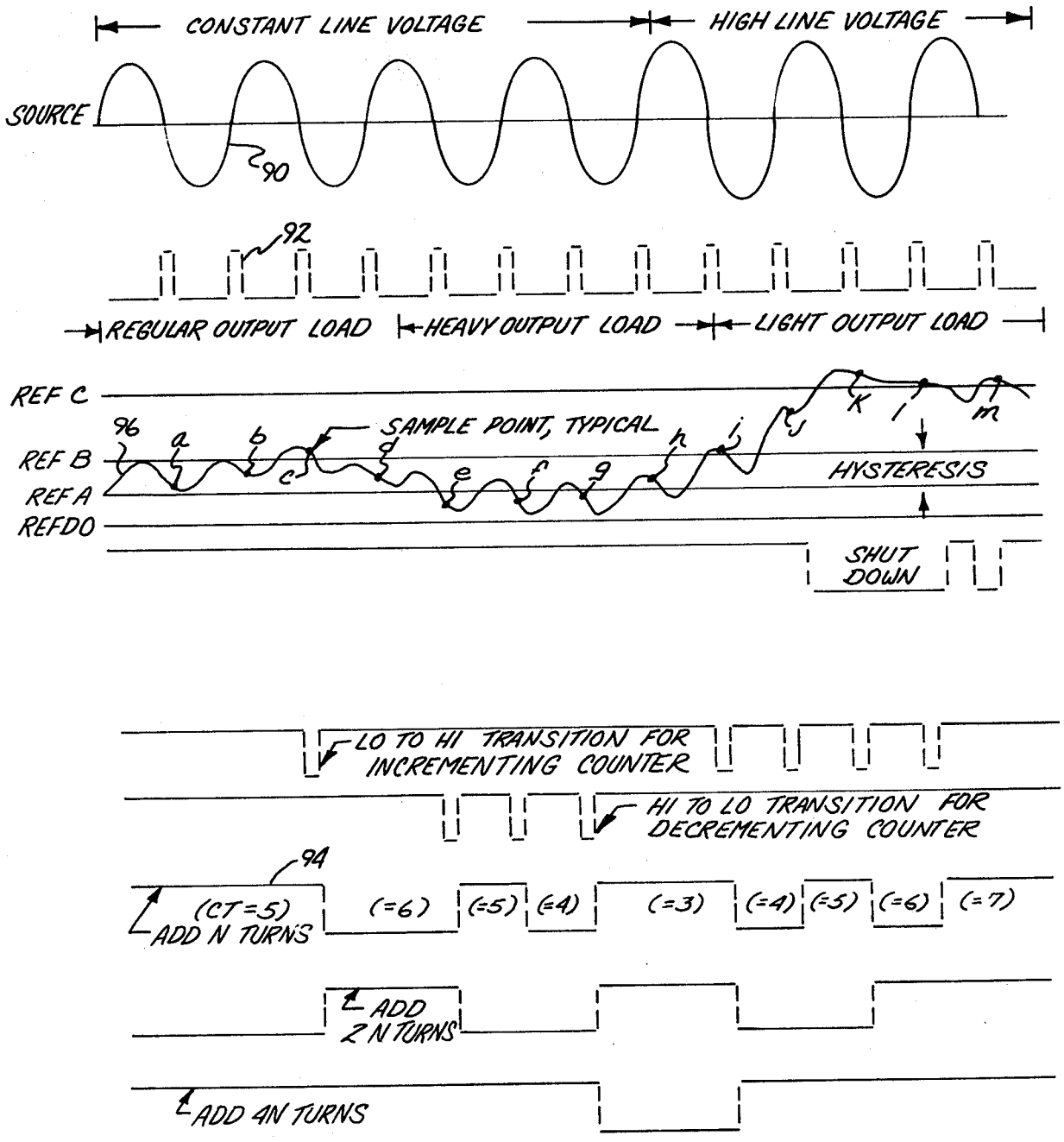
FIG. 2 is a diagram showing the operation of the present invention.
Figure 3A:
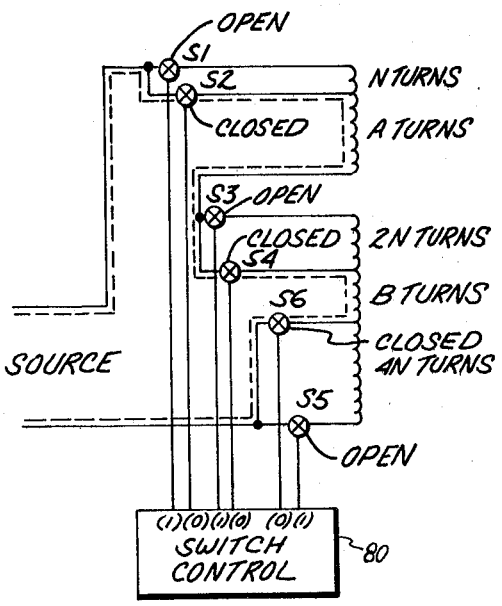
Figure 3B:
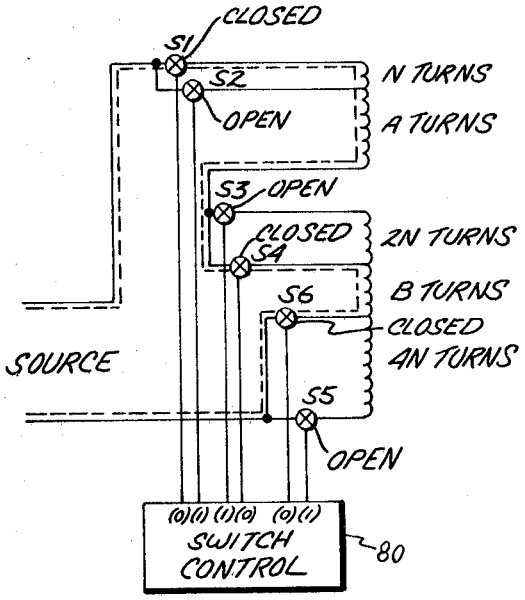
Figure 3C:
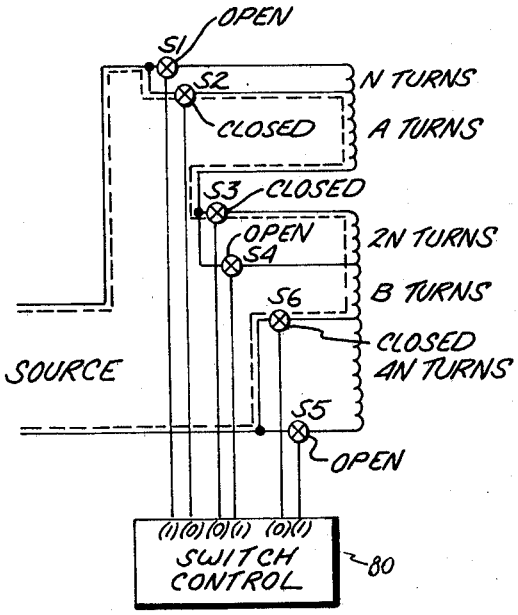
Figure 3D:
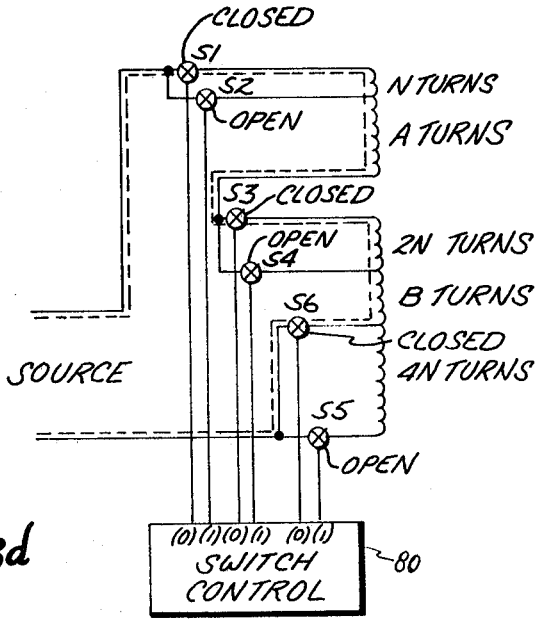

The voltage levels Reference A, Reference B and Reference C are shown in FIG. 2. As noted, voltage regulators such as regulator 40 of FIG. 1 have what is known as a "drop-out voltage" which can be thought of as the minimum operating voltage drop, or the threshhold voltage drop, of the regulator 40. Below the drop-out voltage, which is indicated as "Ref. DO" in FIG. 2, the regulator 40 cannot satisfactorily perform its regulatory function. Minimum power dissipation and therefore minimum wasted energy is realized where the regulator can be held to operate near to but not below the drop-out voltage of regulator 40. Reference A of FIG. 2 is therefore set at a "safe level" of voltage above the drop-out voltage. According to the invention, when sensing circuitry 60 inputs a regulator voltage drop below the Reference A level into comparator circuitry 70, the turns of the primary 10 which are energized must be varied (in a manner later described) to increase the regulator voltage drop. The Reference B voltage level is chosen at some level above the Reference A level. Comparator circuitry 70 is so designed that the voltage region lying between Reference A and Reference B is the desired operating region for the regulator 40. Thus, so long as the voltage drop is between Reference A and Reference B no change is made to the number of primary turns energized. If, however, the voltage drop rises above the Reference B level, then the turns of the primary 10 which are energized must be varied (in a manner later described) to reduce the voltage drop of regulator 40 below Reference B. Finally, if the voltage drop exceeds the Reference C level, the primary 10 is open circuited until the voltage falls below the Reference C level. The voltage region bounded by the Reference A and Reference B levels provides hysteresis which ensures that only relatively stable changes are made to the number of turns of primary 10 which are energized. This hysteresis region prevents the system from hunting between adjacent increments during stable input/output conditions.

To understand the relationship between the voltage drop across regulator 40 and the number of turns of primary 10 which are energized, consider that the voltage of the secondary "$V_s$" comprises the input voltage to the regulator 40. Therefore to reduce the voltage drop across regulator 40, the secondary voltage is reduced, and to increase the voltage drop, the secondary voltage is increased. The voltage across the secondary, $V_s$, is determined according to the following formula:

$$V_s = V_p(N_s/N_p) - V_L$$

In the formula, $V_p$ is the primary voltage, $N_s$ is the number of turns of the secondary, $N_p$ is the number of turns of the primary which are energized, and $V_L$ represent transformer losses. Assuming a constant number of turns in the secondary, $N_s$, there is an inverse relationship between the number of turns of the primary coil which are energized, $N_p$, and the secondary voltage $V_s$. As the formula indicates, by reducing the number of turns of primary 10 which are energized, the secondary voltage and regulator voltage drop are increased. By increasing the number of turns of primary 10 which are energized, the secondary voltage and regulator voltage drops are decreased. Thus, according to the invention, the number of turns of primary 10 which are energized is varied to adjust the secondary coil voltage, and thereby the voltage drop across regulator 40.

Consequently, by comparing the regulator voltage drop sensed by sensing circuitry 60 to the reference levels A, B and C, comparator circuitry 70 can determine whether the voltage drop is within the desired voltage range, in which case no change is made; is too high, in which case the number of turns of primary 10 which are energized must be increased; is too low, in which case the number of turns of primary 10 which are energized must be decreased; or is dangerously too high in which case the primary is open-circuited.

The comparator circuitry 70 is directly coupled to up/down counter and switch control circuitry 80. The count of the up/down counter at any given time represents the proportionate number of selectable turns (N−7N) of primary 10 which are energized. Thus, a count of "3" at the counter indicates that A+B+3N turns of the primary are energized. When the voltage drop is too high, the comparator circuitry 70 indicates to the up/down counter that it should increase the turns of primary 10 which are energized by upcounting 1N turns. Conversely if the voltage drop is too low, the comparator circuitry 70 indicates to the up/down counter that it should increase the voltage drop by downcounting its count by 1N, thereby reducing the turns of primary 10 which are energized by 1N. The count of the up/down counter is decoded by switch control circuitry 80 to ensure that the proper switches $S_1$–$S_6$ are closed to energized the proper number of turns of primary 10. Switches $S_1$–$S_6$ are in pairs: $S_1$ and $S_2$, $S_3$ and $S_4$, and $S_5$ and $S_6$. Switches $S_1$ and $S_2$ control the N turns segment; $S_3$ and $S_4$ control the 2N turns segment; and $S_5$ and $S_6$ control the 4N turns segment. $S_1$ must be closed and $S_2$ opened to energize the N turns segment; $S_3$ must be closed and $S_4$ open to energize the 2N turns segment; $S_5$ must be closed and $S_6$ open to energize the 4N turns segment. At any given time, one of each of the switch pairs must be opened and the other one closed. If both switches of any given pair are closed, the associated segment of primary 10 would short out, and if both switches of any given pair would open the primary 10 would open circuit.

The manner in which the switch pairs are controlled to vary the number of turns of primary 10 which are energized from A+B to A+B+7N turns is shown in FIGS. **3*a*–3*h***.

In FIG. **3*a*, switches $S_2$, $S_4$ and $S_6$ are closed, $S_1$, $S_3$ and $S_5$ are opened, and current travels as indicated by the dotted lines from source 5** through turns A+B. Consequently, only the A & B turns are energized.

In FIG. **3*b***, switches $S_1$, $S_4$ and $S_6$ are closed, $S_2$, $S_3$ and $S_5$ are opened, and turns A+B+N are energized.

In FIG. **3*c***, switches $S_2$, $S_3$ and $S_6$ are closed, $S_1$, $S_4$ and $S_5$ are opened, and turns A+B+2N are energized.

In FIG. **3*d***, switches $S_1$, $S_3$ and $S_6$ are closed, $S_2$, $S_4$ and $S_5$ are opened, and turns A+B+N+2N equal A+B+3N are energized.

In FIG. **3*e***, switches $S_2$, $S_4$ and $S_5$ are closed, $S_1$, $S_3$ and $S_6$ are opened, and turns A+B+4N are energized.

In FIG. **3*f***, switches $S_1$, $S_4$ and $S_5$ are closed, $S_2$, $S_3$ and $S_6$ are opened, and turns A+B+N+4N equal A+B+5N are energized.

In FIG. **3*g***, switches $S_2$, $S_3$ and $S_5$ are closed, $S_1$, $S_4$ and $S_6$ are opened, and turns A+B+2N+4N equal A+B+6N are energized.

In FIG. **3*h***, switches $S_1$, $S_3$ and $S_5$ are closed, $S_2$, $S_4$ and $S_6$ are opened, and turns A+B+N+2N+4N equal A+B+7N are energized.

The switch control circuitry 80, consequently, is designed to open and close the appropriate switches of each switch pair to energize the desired number of turns of primary 10 as dictated by the count signal of the up/down counter. As an example, a count signal of 5 from the up/down counter is decoded through switch control circuitry 80 to close switches $S_1$, $S_4$ and $S_5$ and open switches $S_2$, $S_3$ and $S_6$ to energize 5N selectable turns of the primary together with the A+B "permanently energized" turns.

Figure 5A:
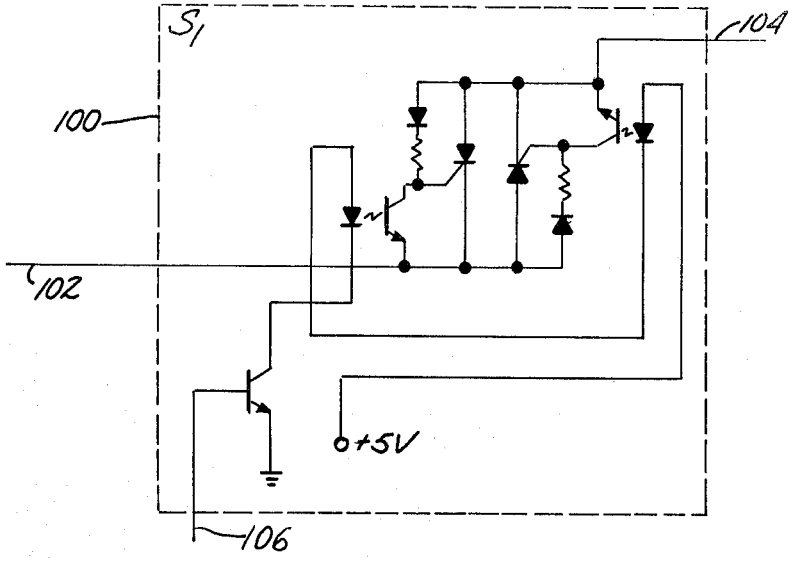
Figure 5B:
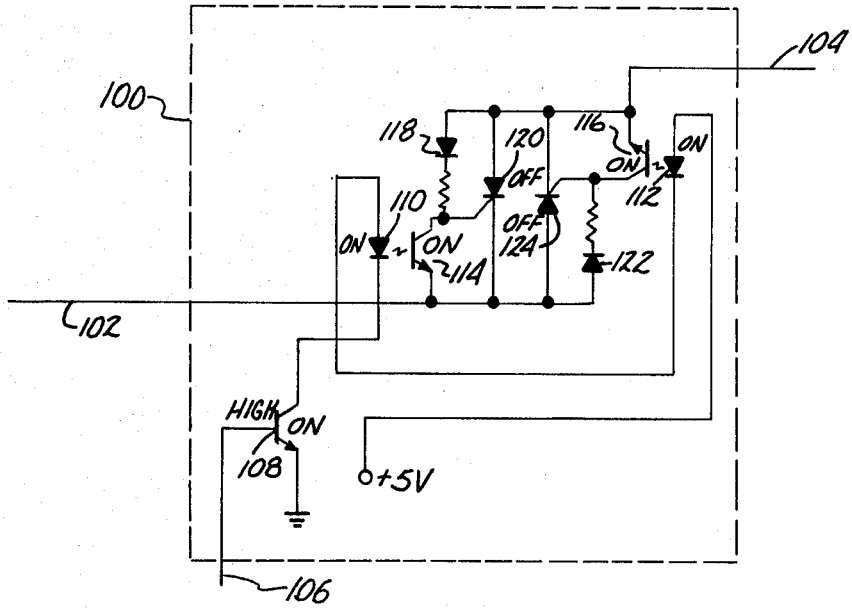
Figure 5C:
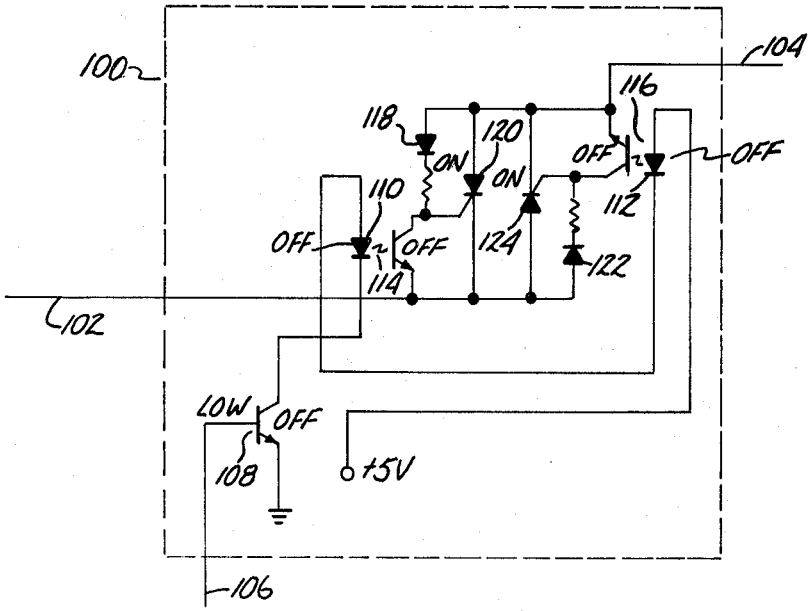

In order to understand the manner in which the switch control circuitry 80 controls the switches $S_1$–$S_6$, the structure of the switches $S_1$–$S_6$ is now explained. FIG. 4 shows the switch circuitry for the switches $S_1$–$S_6$. Note that the circuitry for each of the switches $S_1$–$S_6$ is identical. For purposes of explanation, FIG. **5*a* shows switch $S_1$, comprised of switch circuitry 100. Switch circuitry 100 has an input conductor 102, an output conductor 104 and a control signal conductor 106. The conductors 102, 104 and 106 are also shown in FIG. 4. The circuitry 100 receives a digital signal (either a high or a low) from switch control circuitry 80 via control signal conductor 106. FIG. 5b indicates the operation of circuitry 100 when a high signal is received via conductor 106. The high signal turns transistor 108 "on" which in turn turns LED 110 and LED 112 "on". LEDs 110 and 112 are optically coupled to phototransistors 114 and 116, respectively, and the phototransistors 114, 116 turn "on" in response to LED's 110, 112. When transistor 114 turns "on" it presents a path of minimal resistance to the current moving through diode 118 and the gate of SCR 120 is shorted out so that SCR 120 will not be triggered. Likewise, when transistor 116 conducts, it presents a path of minimal resistance to diode 122 and the gate of SCR 124 is shorted out preventing SCR 124 from being triggered. With the SCRs 120, 124, untriggered, $S_1$ will be open circuited when the source waveform 90 of FIG. 2 returns to zero. That is, the source voltage waveform 90 goes to zero, the voltage across SCRs 120, 124 drops to zero. Since SCRs 120, 124 are untriggered, they turn "off" under this zero voltage condition since the current through them decays to zero or near zero while they are in an untriggered condition. Consequently, a high signal from switch control circuitry 80 via conductor 106 iniates the action which open circuits circuitry 100** and switch $S_1$.

If, conversly, a low signal is applied to the base of transistor 108 via conductor 106, the transistor 108 remains "off", and diodes 110, 112 remain nonconductive. Accordingly, phototransistors 114, and 116 remain "off" and present effectively infinite resistances to the respective diodes 118, 122. Consequently, the gates of the respective SCRs 120, 124 remain enabled and the SCRs 120, 124 comprise a full wave rectifier passing bidirectional current between the AC source 5 and the primary 10. Hence, a low signal from the switch control circuitry enables switch circuitry 100 and closes switch $S_1$. With reference to FIG. 4, it can, therefore, now be appreciated that the high/low digital signals generated by switch control circuitry 80 are transmitted via conductors 106, 126, 136, 146, 156 and 166 to control switches $S_1$–$S_6$, respectively.

Note that while the switch control circuitry described herein employs an SCR pair for each switch $S_1$–$S_6$, a single triac could be substituted for each of the SCR pairs with appropriate other adjustments to the circuitry.

If we utilize a "1" to represent a high, and a "0" to represent a low, the six bit control signals generated by switch control circuitry 80 to vary the number of turns of primary 10 which are energized from A+B to A+B+7N are shown in FIGS. 3a–3h. Circuitry suitable for generating the six bit signals shown in FIGS. 3a–3h from the count of an up/down counter is conventional, would be obvious to one skilled in the art, and therefore is not disclosed in detail. Moreover, given the teachings of the invention, the design of the sensing circuitry 60 and comparator circuitry 70 would also be obvious to one skilled in the art and is not disclosed in detail here in order to avoid undue and unnecessary length in description.

Having disclosed the basic structure of the invention, its operation will now be described with reference to the diagram of FIG. 2. FIG. 2 shows the source wave form 90 of the primary 10. Rather than continually sensing the regulator voltage drop, the sensing circuitry 60 samples the voltage drop at each zero crossover point of the source waveform 90. Thus, the sampling frequency for circuitry 60 is shown as waveform 92 in FIG. 2. Zero-crossing detectors are known in the art. The waveform 94 of FIG. 2 indicates the count of counter circuitry 80 and hence the number of selectable turns of primary 10 which are energized at any given time. At sampling point "a" for example of the regulator voltage drop plot 96, the count is 5 and 5N selectable turns are energized. As plot 96 indicates, the series regulator voltage drop is between Reference A and Reference B at sample point, "a" so no change is required. Sample point "b" is also between Reference A and B. At sampling point "c", however, the regulator voltage drop is above the Referenced B level. This voltage drop level is compared by circuitry 70 to the Reference A, B and C levels and found to be between levels B and C. Comparator circuitry 70, accordingly, generates a first type of error signal causing an upcount at the up/down counter 60 so that the count is increased from 5 to 6. The 6 count of the up/down counter is converted by switch control circuitry 80 to the appropriate six bit binary control signal to close $S_2$, $S_3$ and $S_5$ are open switches $S_1$, $S_4$ and $S_6$ to increase the number of selectable turns of primary 10 which are energized to 6N. See FIG. 39. By increasing the number of turns energized, the secondary voltage, $V_s$, is reduced to reduce the regulator voltage drop as previously discussed.

Sampling point "d" is between reference levels A and B so no change is required. Sampling point "e" falls below Reference A due to a heavy output load as indicated in FIG. 2. In response, comparator 70 generates a second type of error signal which signals the counter of circuitry 80 to downcount the count to 5. In turn, the switch control component of circuitry 80 reduces the number of selectable turns of primary 10 which are energized back to 5N to increase the regulator voltage drop. Sampling point "f" is still below the Reference A level due to the heavy load, so the number of selectable primary turns which are energized is reduced to 4N through the circuitry 60, 70, 80. Sampling point "g" is still below Reference A, so the count at the up/down counter is reduced to 3 and the number of selectable turns of primary 10 which are energized is correspondingly reduced to 3N. Point "h" then falls between referenced levels A and B and no change is required. Point "i" is above the Reference B level, and comparator 70 therefore increases the count of the up/down counter 80 to 4 and the number of selectable primary turns energized is increased to 4N. Point "j" is still above the Reference B level so the count of the counter is increased to 5. Due to the combination of a high line voltage, and light output load (as indicated in FIG. 2), the series regulator voltage drop continues to climb even though the number of selectable primary turns is increased to 5N. At sample point "k", the voltage drop sensing circuitry senses that the regulator voltage drop is above the Reference C level and switch control circuitry 80 opens circuits primary 10. In this open circuit condition, the only input voltage to regulator 40 is from the energy stored in filter capacitor 35. As the capacitor 35 discharges during the primary shut down condition, condition, the count of the counter increases to 7 even though the switches $S_1$–$S_6$ are not controlled by the output of the counter in the shut-down mode. The shut-down mode continues until a subsequent sample point find the voltage below the Reference C level. Counter circuitry 80 includes suitable circuit means to prevent the counter from going "around the bend" when counting up or down. Thus, once the count reaches 7, it does not increment to a count of 0, but remains at 7 until it receives a down count signal. Likewise, once the counter is counted down to 0, it does not down count to 7, but remains at 0 until it receives an upcount signal.

It is finally noted that to prevent both switches of any pair from being simultaneously closed, which would short circuit the coil, circuiting would be employed to ensure that both SCRs of any given switch pair are unlatched before the associated pair of SCRs are enabled. Thus, for example, such circuitry would ensure that both SCRs of switch $S_1$ are unlatched and nonconducting before either of the SCRs of switch $S_2$ are enabled. Given the teachings of the invention, such circuitry would be obvious to those skilled in the art and is not described here to avoid undue and unnecessary length in description.

Having disclosed the presently preferred embodiment of the invention, many modifications and variations thereof would be obvious to one skilled in the art. The invention, therefore, is intended to be limited only by the scope of the appended claims.

I claim:

1. A circuit including a transformer having a primary comprised of a plurality of turns, and a secondary comprised of a plurality of turns, and a voltage regulator operationally intermediate to said secondary and a load, said voltage regulator having an input voltage and an output voltage and a drop-out voltage, comprising:

a means for sensing the voltage drop across said voltage regulator, said voltage drop being the difference between said input voltage and said output voltage;

means for comparing said voltage drop to a first reference voltage level above said drop-out voltage, and a second reference voltage level above said first reference voltage level, said first reference voltage level and said second reference voltage level comprising a desired voltage range, said voltage drop being input to said comparing means by said sensing means, said comparing means generating a first error signal whenever said voltage drop is below said first reference voltage level, and a second error signal whenever said voltage level is above said second reference voltage level; and a means for varying the number of turns of said primary in response to said first and second error signals being output from said comparing means to maintain said voltage drop within said desired voltage range, said varying means reducing the number of turns of said primary which are energized to increase said input voltage to said series regulator in response to said first error signal, said varying means increasing the number of turns of said primary which are energized to reduce said input voltage to said voltage regulator in response to said second error signal.

2. The circuit of claim 1 wherein said varying means comprises an up/down counter and switch control circuitry, said primary being divided into a plurality of segments by a plurality of taps, a plurality of switches being electrically connected to said taps, said switch control circuitry being operable to selectively open and close said switches independently, said up/down counter having a count and count output signal representative of said count, said count output signal being input to said switch control circuitry, said switch control circuitry selectively opening and closing said switches to energize selected segments of said primary to vary the number of turns of said primary which are energized to correspond to said count of up/down counter.

3. The circuit of claims 2 wherein said comparator inputs said first error signal and said second error signal to said up/down counter, said up/down counter decreasing said count in response to said first error signal and increasing said count in response to said second error signal.

4. The circuit of claim 3 wherein said primary coil is comprised of a first permanent segment and a second permanent segment, and a first selectable segment and a second selectable segment and a third selectable segment, further comprising a first pair of switches for controlling said first selectable segment, a second pair of switches for controlling said second selectable segment, and a third pair of switches for controlling a third selectable segment, said switch control circuitry opening for one of said switches and closing the other said switches of said first, second and third pair of switches respectively to selectively energize said first, second or third selectable segments.

* * * * *